US007961071B2

(12) United States Patent
Earle

(10) Patent No.: US 7,961,071 B2
(45) Date of Patent: Jun. 14, 2011

(54) MULTIPHASE INDUCTOR AND FILTER ASSEMBLIES USING BUNDLED BUS BARS WITH MAGNETIC CORE MATERIAL RINGS

(75) Inventor: John K. Earle, Raleigh, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/254,400

(22) Filed: Oct. 20, 2008

(65) Prior Publication Data

US 2010/0097169 A1 Apr. 22, 2010

(51) Int. Cl.

| | |
|---|---|
| ***H01F 17/06*** | (2006.01) |
| ***H01F 29/00*** | (2006.01) |
| ***H01F 21/02*** | (2006.01) |
| ***H01F 38/20*** | (2006.01) |
| ***H01F 27/28*** | (2006.01) |

(52) U.S. Cl. ..... 336/175; 336/69; 336/138; 336/173; 336/186

(58) Field of Classification Search ..... 336/69, 336/138, 173, 175, 186
See application file for complete search history.

(56) References Cited

U.S. PATENT DOCUMENTS 1,752,320 A * 4/1930 White ..... 307/90
2,994,844 A * 8/1961 Niederman ..... 333/185
3,243,663 A * 3/1966 Rowe ..... 361/637
4,945,188 A * 7/1990 Jackson ..... 174/16.2
7,132,915 B2 * 11/2006 Moore et al. ..... 336/55

FOREIGN PATENT DOCUMENTS

DE 102005013509 10/2005

OTHER PUBLICATIONS

English translation provided for DE102005013509.*
NN76122596, Power Filter Configuration, Dec. 1, 1976, IBM Technical Disclosure Bulletin, vol. No. 19, Issue No. 7, p. 2596-2597.*

* cited by examiner

*Primary Examiner* — Lincoln Donovan
*Assistant Examiner* — Tszfung Chan
(74) *Attorney, Agent, or Firm* — Myers Bigel Sibley & Sajovec, P.A.

(57) ABSTRACT

A multiphase inductor assembly includes an elongate conductor assembly including a plurality of bus bars that are arranged in parallel. A plurality of magnetic core material rings (e.g., ferrite or mu metal rings) surround the conductor assembly and are distributed along a length thereof. Terminals are electrically coupled to the bus bars and disposed between spaced apart ones of the magnetic core material rings. In some embodiments, the conductor assembly, in cross-section, includes respective ones of the bus bars disposed in respective quadrants. For example, each of bus bars may have a quarter-cylinder shape and may be arranged such that the conductor assembly has a circular cross-section. In other embodiments, each of the bus bars may have a polygonal cross-section, e.g., may be formed from standard rectangular bar stock.

15 Claims, 5 Drawing Sheets

MULTIPHASE INDUCTOR AND FILTER ASSEMBLIES USING BUNDLED BUS BARS WITH MAGNETIC CORE MATERIAL RINGS

BACKGROUND OF THE INVENTION

The invention relates to electric circuit components and, more particularly, to inductors and filters suitable for high-current applications.

Power supply systems, such as uninterruptible power supplies (UPSs), often employ passive filters that are used to suppress high frequency emissions that may create interference and disrupt the operations of sensitive equipment. In some applications, such filters may need to be able to support relatively large currents, e.g., currents which may exceed one thousand amperes.

Conventional high-current filter designs commonly are constructed by coiling wire or by wrapping wire around a ferrite core. To construct filters, these inductors may be connected to capacitors using terminal blocks or other type of wired connections.

Such filter designs may work effectively for filter applications at relatively low currents but, for higher current filter applications, terminal block connections may become cumbersome and unreliable. Multiple heavy-gauge cables connected in parallel may be needed to support large currents, which may necessitate the use of multiple terminal blocks. Additional terminal blocks may introduce losses and increase the likelihood of bad connections that may lead to overloads or other malfunctions.

SUMMARY OF THE INVENTION

Some embodiments of the present invention provide a multiphase inductor assembly including an elongate conductor assembly including a plurality of bus bars arranged in parallel. A plurality of magnetic core material rings (e.g., ferrite or mu metal rings) surround the conductor assembly and are distributed along a length thereof. Terminals are electrically coupled to the bus bars and disposed between spaced apart ones of the magnetic core material rings. In some embodiments, the conductor assembly, in cross-section, includes respective ones of the bus bars disposed in respective quadrants. For example, each of bus bars may have a quarter-cylinder shape and may be arranged such that the conductor assembly has a circular cross-section. In other embodiments, each of the bus bars may have a polygonal cross-section, e.g., may be formed from standard bar stock. The terminals may include respective tapped holes in the surfaces of the bus bars. Positioning of the magnetic core material rings along the length of the conductor assembly may be adjustable. A filter assembly may include such an inductor assembly and a plurality of capacitors connected to the terminals of the inductor assembly.

Further embodiments provide a multi-phase conductor assembly including a plurality of elongate bus bars configured in a bundle such that, in cross-section, the bundle has a respective one of the bus bars in a respective quadrant, at least one insulator separating the bus bars from one another and a plurality of terminals electrically coupled to the bus bars and spaced apart along a length of the bundle. Each of the bus bars may be quarter-cylinder shaped and the bus bars may be arranged such that the bundle has a circular cross-section. In some embodiments, the metal bars are arranged such that the bundle has a polygonal cross-section.

DETAILED DESCRIPTION OF EXEMPLARY EMBODIMENTS

Figure 1:
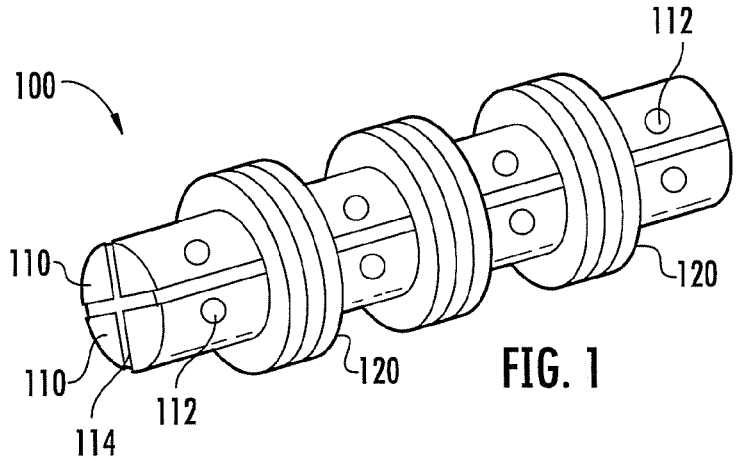
FIGS. 1 and 2 are views of an inductor assembly according to some embodiments of the present invention.

Specific exemplary embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

Some embodiments of the present invention provide multiphase inductor assemblies for use in high-current applications, such as high-current filters used in UPS applications. Such inductors may utilize a bundled bus bar structure surrounded by magnetic core material rings that are distributed along the bundle of bus bars. The bus bars may be shaped for maximal or near-maximal cross-sectional area to support high current densities. The rings may be grouped in varying numbers to provide a desired inductance. Terminals (e.g., tapped holes for receiving bolts to mount lugs or other connector structures) may be coupled to the bus bars between the groups and may be used for capacitor and other circuit connections. The rings and terminals may be reconfigurable to support, for example, in situ tuning or other modifications.

Figure 2:
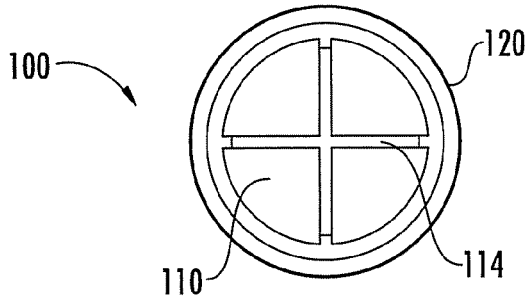
Figure 3:
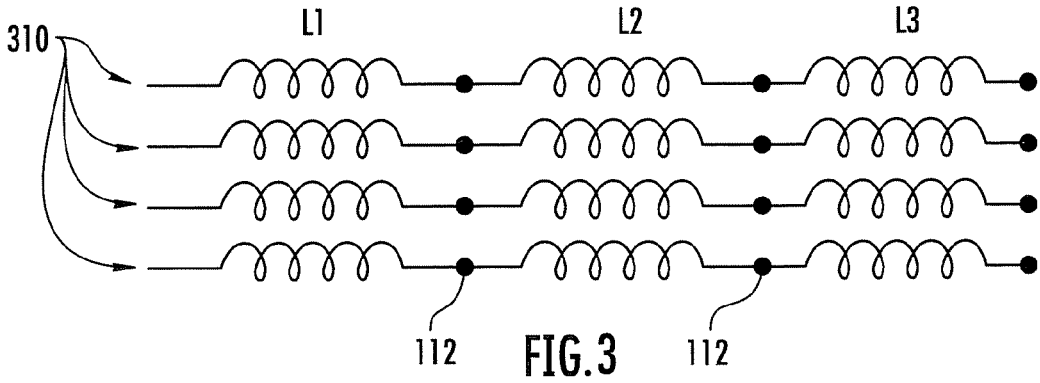
FIG. 3 is a circuit diagram illustrating an equivalent circuit model for the inductor assembly of FIGS. 1 and 2.

FIGS. 1 and 2 illustrate an inductor assembly 100 according to some embodiments of the present invention. The inductor assembly 100 includes a bundle of elongate bus bars 110 arranged mechanically in parallel and separated from one another by an insulator 114. Circular magnetic core material rings 120 surround the bundle of bus bars 110 and are distributed along the length of the bundle of bus bars 110. As shown, the rings 120 may be grouped in various numbers depending on the inductance desired, with electrical terminals 112 provided between the groups of rings 120. As explained in detail below, the terminals 112 may be used to connect capacitors or other circuit components in filter and other applications. The inductor assembly 100 shown in FIGS. 1 and 2 may effectively provide the equivalent circuit shown in FIG. 3, including four inductor circuits 310, each comprising three series-connected inductors L1, L2, L3 corresponding to respective groups of the magnetic core material rings 120. The rings 120 may include any of a variety of different magnetic core materials having different levels of magnetic permeability, such as ferrite and mu metal.

Referring to the radial cross-section shown in FIG. 2, the bus bars 110 are quarter-cylinder shaped and are disposed in different quadrants such that the bundle of bus bars 110 has a circular cross-section and substantially fills the volume defined by the rings 120. Such an arrangement may maximize maximum current density for a given size of the rings 120, but it will be understood that the bus bars may have different shapes and/or may arranged in a different manner, such as in stacked or other arrangements. The insulator 114 may be a unitary piece of insulating material (e.g., a plastic or polyimide layer), or may have a different configuration, such as multiple pieces of insulating material and/or insulating standoffs that support an insulating air gap. The terminals 112 may include, for example, tapped holes formed in surfaces of the bus bars 110 that are configured to accept bolts for connection of lugs or other types of connectors.

Figure 4:
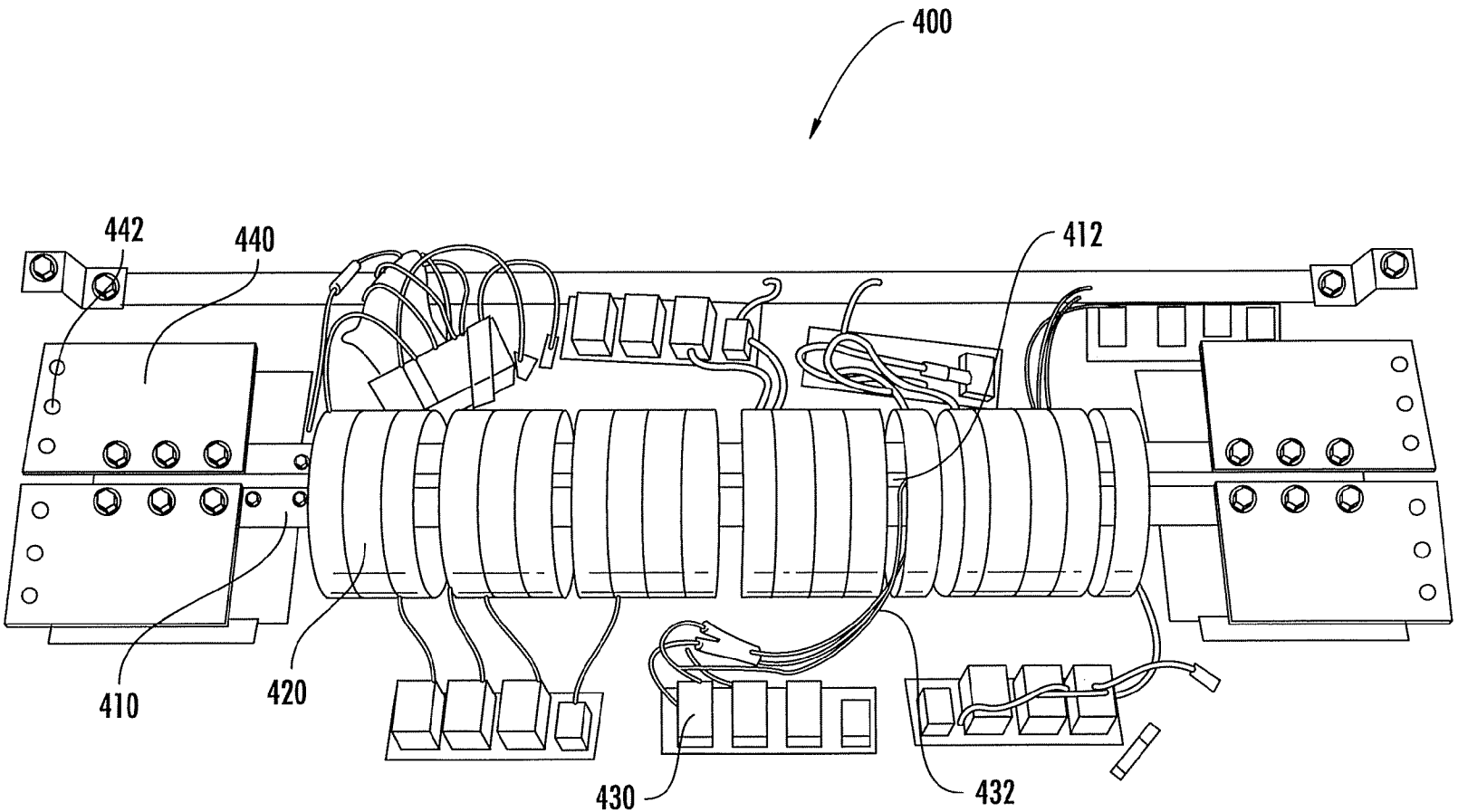
FIGS. 4-6 are views of an inductor assembly according to further embodiments of the present invention.
Figure 5:
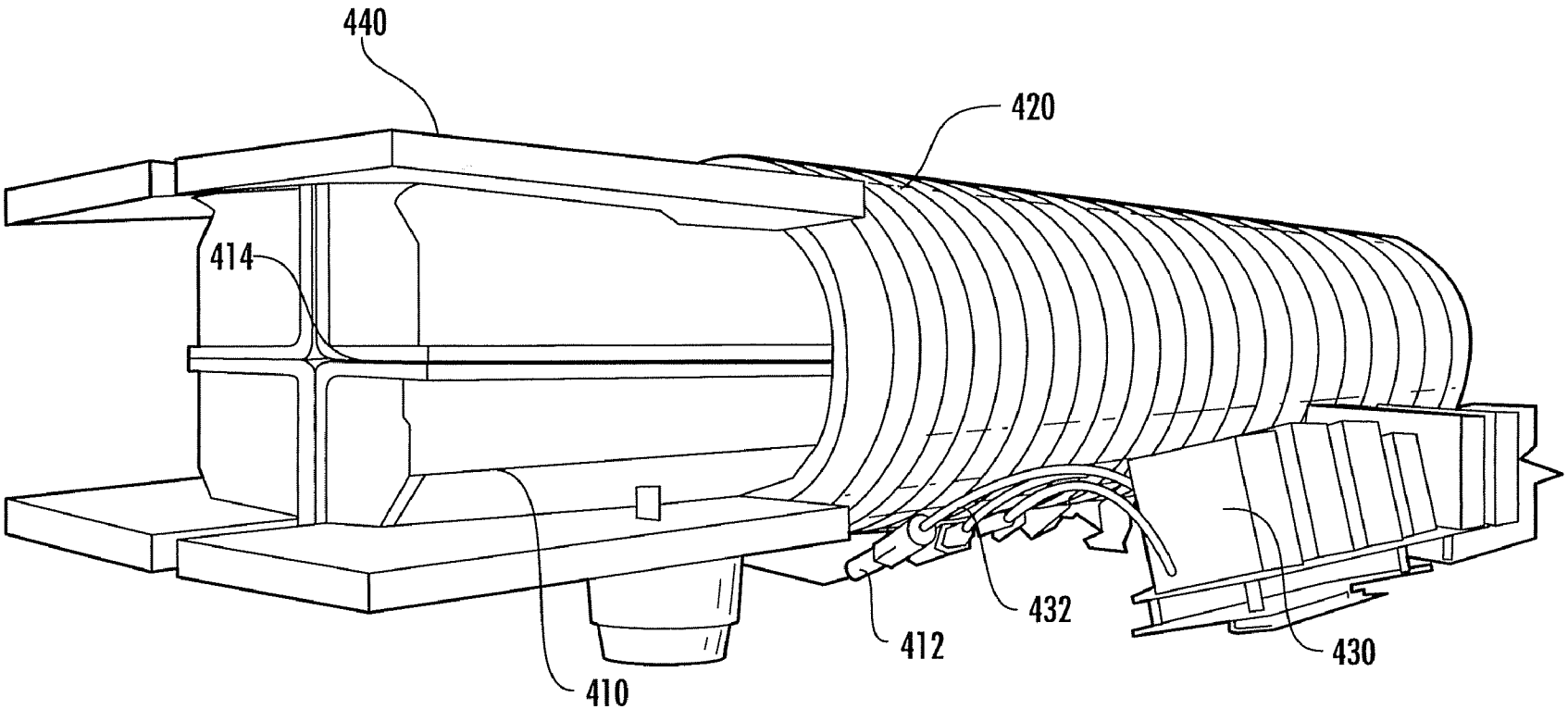
Figure 6:
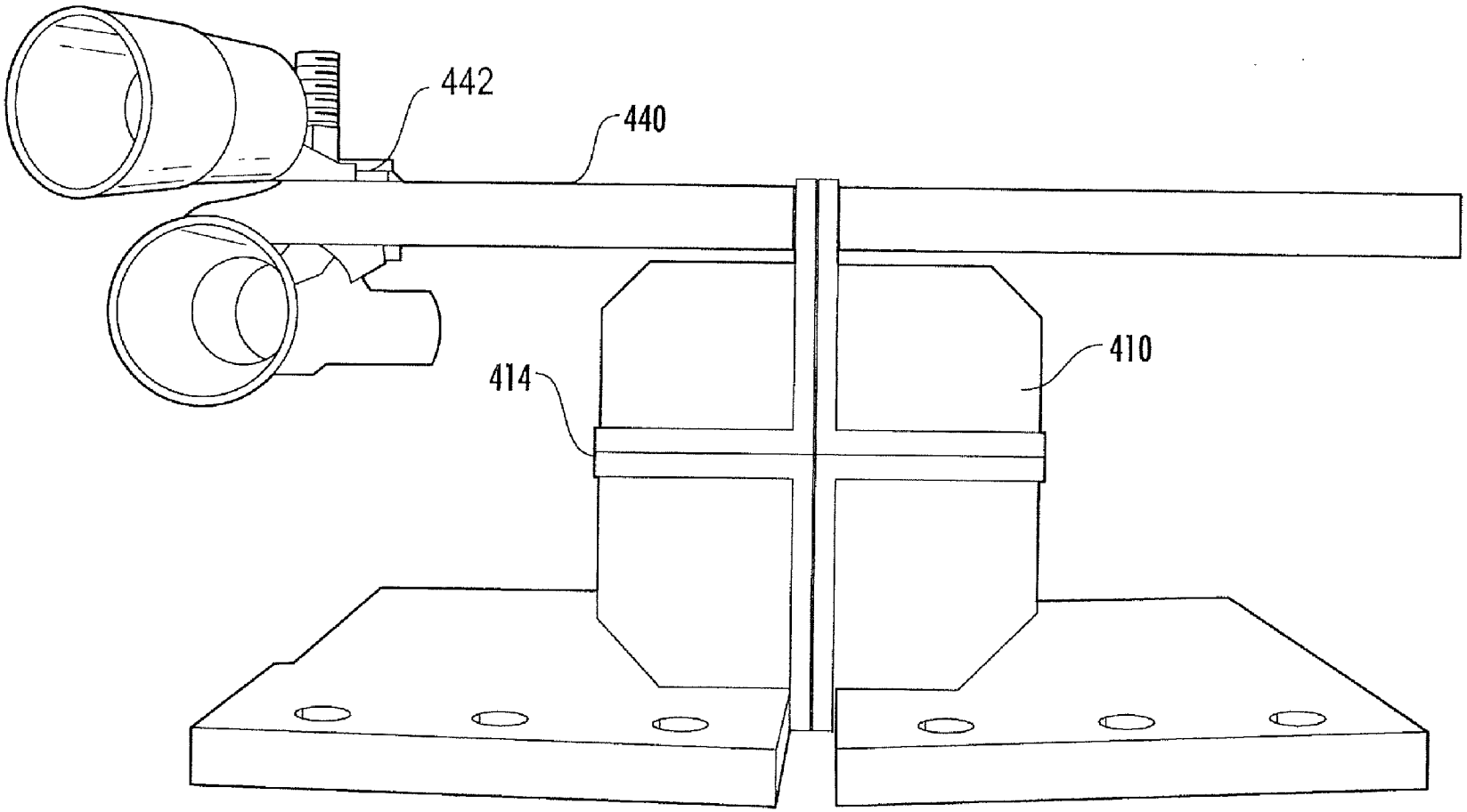

FIGS. 4-6 illustrate a multi-phase filter assembly 400 according to further embodiments of the present invention. The filter assembly 400 includes an inductor assembly along the lines discussed above, including a bundle of elongate bus bars 410 and magnetic core material rings 420 surrounding the bus bars 410 and distributed in groups along a length of the bundle. Electrical terminals, in particular, tapped holes 412, are provided between the groups of rings 420. Wires 432 bolted to the tapped holes 412 connect circuit-board mounted capacitors 430 to the bus bars 410. Respective conductive plates 440 are connected to respective ones of the bus bars 410, and include terminals 442 to which electrical conductors may be connected. The terminals 442 may be used, for example, to connect respective ones of the plates to respective phase (and neutral) conductors using lugs or other structures.

Figure 7:
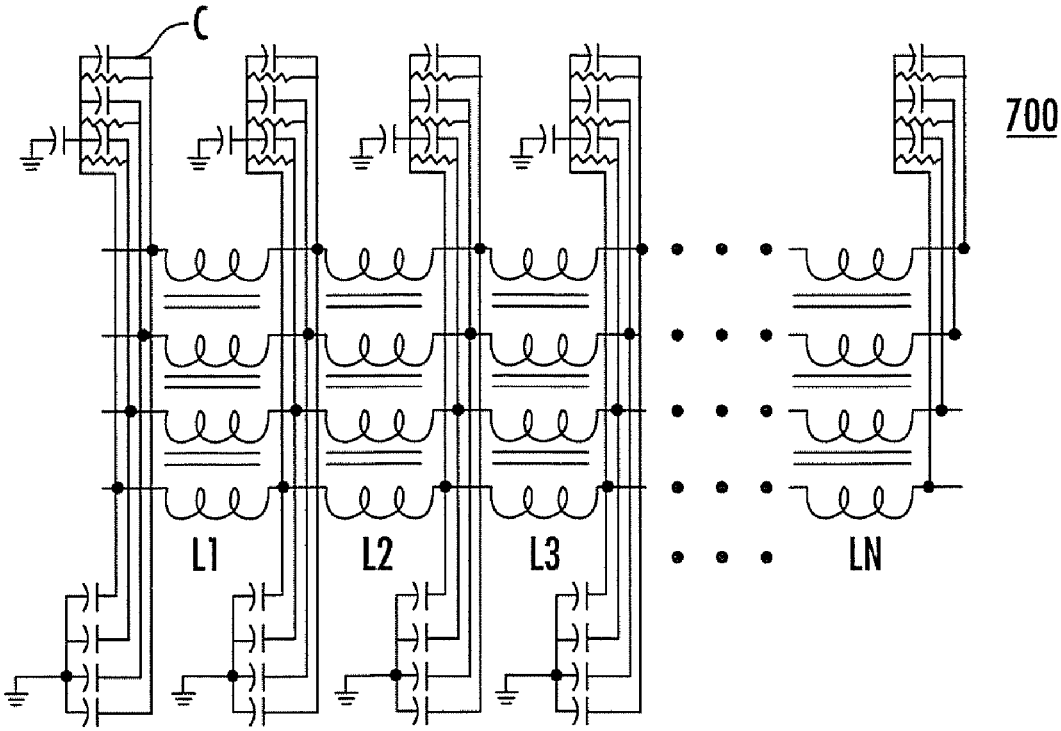
FIG. 7 is a circuit diagram illustrating an equivalent circuit model for a multi-phase filter assembly according to further embodiments of the present invention.

As shown in FIGS. 5 and 6, the bus bars 410 may have a polygonal cross-section and may be arranged so that the bundle has a polygonal cross-section. For example, for relative simplicity and low cost of construction, the bus bars 410 may be formed from square aluminum bar stock that has been chamfered at one edge so that, when combined in a bundle, the bundle has a near-maximum cross-section that fits within the cylindrical space defined by the rings 420. The bus bars 410 may be electrically insulated from one another by insulating material, here pieces of plastic angle stock 414 that conform to inner faces of the bus bars 410. The conductive plates 440 are bolted to the bus bars 410 using tapped holes therein and include holes 442 that may be used to bolt conductors (e.g., phase or neutral conductors) to the plates 440. FIG. 7 illustrates an exemplary filter circuit 700 that may be implemented using a structure along the lines illustrated in FIGS. 4-6. The filter circuit 700 includes sets of serially-connected inductors L1, L2, L3, . . . , LN, with capacitor networks C connected to terminals between the inductors L1, L2, L3, . . . LN.

Inductor assemblies and filter assemblies according to embodiments of the present invention can provide several advantages over conventional designs. The unbroken bus bar structure used in some embodiments of the present invention can reduce losses. The reconfigurable inductor structure provided by some embodiments of the present invention can support in situ reconfiguration and/or tuning. Such structures may have manufacturing advantages, as a common set of parts (e.g., conductive bars, insulators and ferrite rings) can be used to fabricate a range of inductors and filters with different characteristics by, for example, varying the number and/or positioning of the rings and the position of capacitor connections.

In the drawings and specification, there have been disclosed exemplary embodiments of the invention. Although specific terms are employed, they are used in a generic and descriptive sense only and not for purposes of limitation, the scope of the invention being defined by the following claims.

That which is claimed:

1. A multiphase inductor assembly comprising:

an elongate conductor assembly comprising a plurality of bus bars arranged in parallel, wherein the conductor assembly, in cross-section, comprises respective ones of the bus bars disposed in respective ones of four different quadrants;

a plurality of magnetic core material rings surrounding the conductor assembly and arranged along a length thereof in at least three spaced apart groups, each group comprising at least one magnetic core material ring; and a plurality of terminals electrically coupled to the bus bars and disposed between spaced apart ones of the magnetic core material rings, wherein the plurality of terminals comprises at least one terminal disposed between a first pair of the groups of magnetic core material rings and at least one terminal disposed between a second pair of the groups of magnetic core material rings.

2. The inductor assembly of claim 1, wherein each of bus bars has a quarter-cylinder shape.

3. The inductor assembly of claim 1, wherein each of the bus bars has a polygonal cross-section.

4. The inductor assembly of claim 1, wherein the terminals comprise respective tapped holes in the surfaces of the bus bars.

5. The inductor assembly of claim 1, wherein positioning of the magnetic core material rings along the length of the conductor assembly is adjustable.

6. The inductor assembly of claim 1, wherein the magnetic core material rings are circular.

7. The inductor assembly of claim 1, wherein the magnetic core material rings comprise ferrite rings.

8. A filter assembly comprising the inductor assembly of claim 1 and a plurality of capacitors connected to the terminals.

9. The inductor assembly of claim 1, wherein each of the bus bars is quarter-cylinder shaped and wherein the bus bars are arranged such that the conductor assembly has a circular cross-section.

10. A multiphase filter assembly comprising:

a plurality of elongate metal bars arranged in a bundle and separated from one another by at least one insulating layer, wherein the bundle, in cross-section, comprises respective ones of the metal bars disposed in respective ones of four different quadrants;

a plurality of magnetic core material rings surrounding the bundle of metal bars and distributed along a length thereof in at least three spaced apart groups, each group comprising at least one magnetic core material ring;

a plurality of terminals electrically coupled to the metal bars and disposed between spaced apart ones of the magnetic core material rings, wherein the plurality of terminals comprises at least one terminal disposed between a first pair of the groups of magnetic core material rings and at least one terminal disposed between a second pair of the groups of magnetic core material rings; and a plurality of capacitors connected to the terminals.

11. The filter assembly of claim 10, wherein each of the metal bars is quarter-cylinder shaped and wherein the metal bars are arranged such that the bundle has a circular cross-section.

12. The filter assembly of claim 10, wherein the metal bars are arranged such that the bundle has a polygonal cross-section.

13. The filter assembly of claim 10, wherein the terminals comprise respective tapped holes in the surfaces of the metal bars.

14. The filter assembly of claim 10, wherein the magnetic core material rings are circular.

15. The filter assembly of claim 10, wherein the magnetic core material rings comprise ferrite rings.

* * * * *